United States Patent [19]

Pircher

[11] Patent Number: 4,735,040

[45] Date of Patent: Apr. 5, 1988

[54] METHOD OF AND APPARATUS FOR THE AUTOMATIC FEEDING OF FILLED CANS AND THE AUTOMATIC REMOVAL OF EMPTY CANS FROM THE SPINNING UNITS OF A SPINNING MACHINE

[75] Inventor: Herbert Pircher, Planegg, Fed. Rep. of Germany

[73] Assignee: Buro Patent AG, Glarus, Switzerland

[21] Appl. No.: 10,275

[22] PCT Filed: Mar. 6, 1986

[86] PCT No.: PCT/CH86/00030

§ 371 Date: Dec. 30, 1986

§ 102(e) Date: Dec. 30, 1986

[87] PCT Pub. No.: WO86/06358

PCT Pub. Date: Nov. 6, 1986

[30] Foreign Application Priority Data

Apr. 30, 1985 [CH] Switzerland ..... 01829/85

[51] Int. Cl.[4] ..... D01H 9/18

[52] U.S. Cl. ..... 57/266; 19/159 A; 57/90; 57/276; 57/281

[58] Field of Search ..... 57/90, 276, 266, 267, 57/281; 19/159 R, 159 A

[56] References Cited

U.S. PATENT DOCUMENTS

| | | | |
|---|---|---|---|
| 3,132,461 | 5/1964 | Arai | 57/281 X |
| 3,147,817 | 9/1964 | Deliban | 180/82 |
| 3,716,979 | 2/1973 | Handschuh et al. | 57/281 |
| 3,884,026 | 5/1975 | Yoshizawa et al. | 19/159 A X |
| 3,973,906 | 8/1976 | Tooka | 57/281 X |
| 4,012,893 | 3/1977 | Weber | 19/159 A X |
| 4,033,104 | 7/1977 | Kamp | 57/281 |
| 4,083,170 | 4/1978 | Raasch | 57/281 |
| 4,150,534 | 4/1979 | Raasch | 57/90 X |
| 4,469,214 | 9/1984 | Maurer et al. | 57/281 X |
| 4,537,018 | 8/1985 | Tooka | 57/276 X |

FOREIGN PATENT DOCUMENTS

| | | |
|---|---|---|
| 2646268 | 4/1977 | Fed. Rep. of Germany . |
| 2646313 | 4/1978 | Fed. Rep. of Germany . |
| 589557 | 7/1977 | Switzerland . |

*Primary Examiner*—John Petrakes

*Attorney, Agent, or Firm*—Karl F. Ross; Herbert Dubno

[57] ABSTRACT

A station (24) is connected to the spinning units ($4_1$ to $4_n$) along a spinning machine ($2_1$ to $2_3$) via floor-conveyor installation (20). The floor-conveyor truck (22) has three arms (46, 48, 50) extendable transversally to the direction of movement, wherefrom the first is built to receive and set in place a full can (V), the second to receive and depose an empty can (L). The third arm (50) serves for the displacement of the cans(E) in use. The spinning units ($4_1$ to $4_8$ to $4_n$) are equipped with transmitters ($42_1$ to $42_8$ to $42_n$) through which the floor-conveyor truck (22) are set in motion starting from the station (24). The floor-conveyor truck (22) is provided with a first control unit (28) for an automatic running and with a second control unit (30) for the automatic receiving and placement of cans.

7 Claims, 2 Drawing Sheets

2/2

METHOD OF AND APPARATUS FOR THE AUTOMATIC FEEDING OF FILLED CANS AND THE AUTOMATIC REMOVAL OF EMPTY CANS FROM THE SPINNING UNITS OF A SPINNING MACHINE

CROSS REFERENCE TO RELATED APPLICATIONS

This application is a national phase application corresponding to PCT/CH86/0030 filed Mar. 6, 1986 and based, in turn, on Swiss application No. 01829/85-2 filed Apr. 30, 1985

FIELD OF THE INVENTION

The invention relates to method of and an apparatus for the automatic feeding of full cans and the automatic removed of empty cans from the spinning units of a spinning machine.

More particularly, the invention relates to an apparatus having a supply station which is connected with the spinning units along a spinning machine via a floor-conveyor installation with at least one independently moving floor-conveyor truck. The floor-conveyor truck comprises a plurality of arms extendable transversely to the direction of movement and including a first arm arranged to receive and deliver a full can and a second arm constructed to receive and deliver an empty can. The spinning units are equipped with transmitters for transmitting orders to the conveyor truck and the conveyor truck has a first control unit for an automatic control of its displacement and a second control unit for the automatic receiving and delivery of the cans.

BACKGROUND OF THE INVENTION

In spinning mills, it is usual to lay out several large spinning machines parallel to each other, whereby the individual spinning machines have a plurality of spinning units, for instance 20 to 200 units, on each side receiving the fiber strands to be spinned from cans which are arranged standing on the bottom, underneath the spinning units. As a rule, two cans are provided for each spinning unit, whereby from one of the cans the fiber strand is taken up for spinning, and the other can is either a full spare can or an already empty one. As a rule, the fiber strand is taken up from the can which stands in the front, in the first row. As soon as this is empty, it is replaced by the full can standing in the second row. The supply, exchange and monitoring of the cans at the spinning units are relatively time-consuming and cumbersome.

From the German open application DE OS No. 26 46 313 and installation of the afore-described kind is known which makes possible the automatic exchange of cans at the spinning units of a spinning machine. The conveying installation used is an overhead conveyor whose tracks are arranged at the spinning machine. The conveyor truck comprises two arms, of which one arm serves for the receiving of an empty can from the spinning unit and its evacuation, while the other arm serves for the feeding and delivery of full cans to the spinning unit. In order to be able to manipulate the cans arranged one after the other in rows at a spinning unit, three or four cans of neighboring spinning units are arranged on a turn table, which is actuatable from the devices of the conveyor truck. This apparatus has the disadvantage that all spinning units have to be equipped with such complicated turntables, whereby it becomes expensive and complicated to operate, especially since the mounting of such a conveying installation at already existing spinning machines is not possible for many reasons, and in any case would be complicated and expensive.

OBJECT OF THE INVENTION

It is the object of the invention to provide an apparatus of the type described, which is especially simple and necessitates little intervention at the spinning machine as possible, so that it can also be mounted on spinning machines which are already in use.

SUMMARY OF THE INVENTION

This object is attained, in accordance with the invention in that the floor-conveyor truck has a third arm extendable transversely to the direction of movement, which preferably is mounted between the first and the second arms and serves to grip for a limited time a can in use at the spinning units making it possible to pick up an empty can positioned behind this gripped can. Due to the additional or third arm for the time-limited engagement of a can in use at the spinning unit, the cans can be manipulated at the spinning unit without complicated turntables. As a result, the installation is extremely simple and requires practically no modification in the spinning machines already in use, which makes possible an easy upgrading of already existing spinning machines.

The installation can be operated in diverse ways. Particularly advantageous is the mode of operation whereby: the conveyor truck stops first at the spinning unit with its third arm in order to grip and hold a front can in use standing in the first row;

then the conveyor truck approaches the spinning unit with its second arm and with the aid of this second arm brings the rear empty can positioned in the second row to the conveyor truck;

then the conveyor truck approaches again the spinning unit with its third arm and by extending this third arm places the can in use in the rear second row; and thereafter the conveyor truck retracts its third arm and approaches the spinning unit with its first arm and the first arm places the full can in the front in the first row.

Advantageously each arm has a vertical carrier column, which preferably rests on the floor via casters and is supported on thrust rods, and has at its lower end lateral support arms for the can and at the upper end a holder for the can.

The carrier column can have a support extension at its lower end for the deposition of the cans.

The holder can be a vertically movable immobilizer, which grips the can from above and at the immobilizer close to the carrier column a holding extension can be provided.

The holder can be a vertically movable arm which has clamping jaws fastenable to the upper rim of the can. One of these clamping jaws can be rigidly mounted, with a vertical orientation, close to the carrier column and the other clamping jaw can be horizontally oriented in open position and swingable against the fixed clamping jaw.

The arms can have sensors which respond to the weight of the can to be removed, and are connected to the second control unit.

The conveyor can be a floor-conveyor installation without tracks.

For receiving the cans from the arms of the conveyor truck, therefore, there are several possible techniques within the invention. Thus it is, for instance, possible to pick up the can with gripping means surrounding the can. However, since the individual cans stand very close to each other at the spinning unit, an embodiment the vertical carrier column is more advantageous, since it requires practically no lateral clearance around the cans. For receiving the can, a support extension can be provided at the carrier columm. Thereby, a development according to claim 4 is advantageous, in order to hold the can on the support extension.

It is possible to grip the upper rim of a can and to lift the can. The lower support extensions can then be eliminated, which improves the accessibility of the arm and the gripping of the can. A horizontally positionable gripping jaw does not impair the accessibility of the holder and it has to be lifted very little over the height of the can, when it approaches the can, thereby affording a particularly flat construction. The ability to detect the can weight is of particular advantage, since the arm can then determine to what degree a can to be received is still filled.

Automatic conveyors are sufficiently well known. The conveyor installation can be either an overhead conveyor or a floor-conveyor on tracks. Particularly advantageous is however a rail-less floor conveyor, since it requires a minimum of modification in already existing spaces and installations. The conveyor truck can be moved along a routing track, such as for instance a routing cable or a routing track arranged on the floor, consisting for instance of a metallic strip or of an optically-effective strip.

SPECIFIC DESCRIPTION

Figure 1:
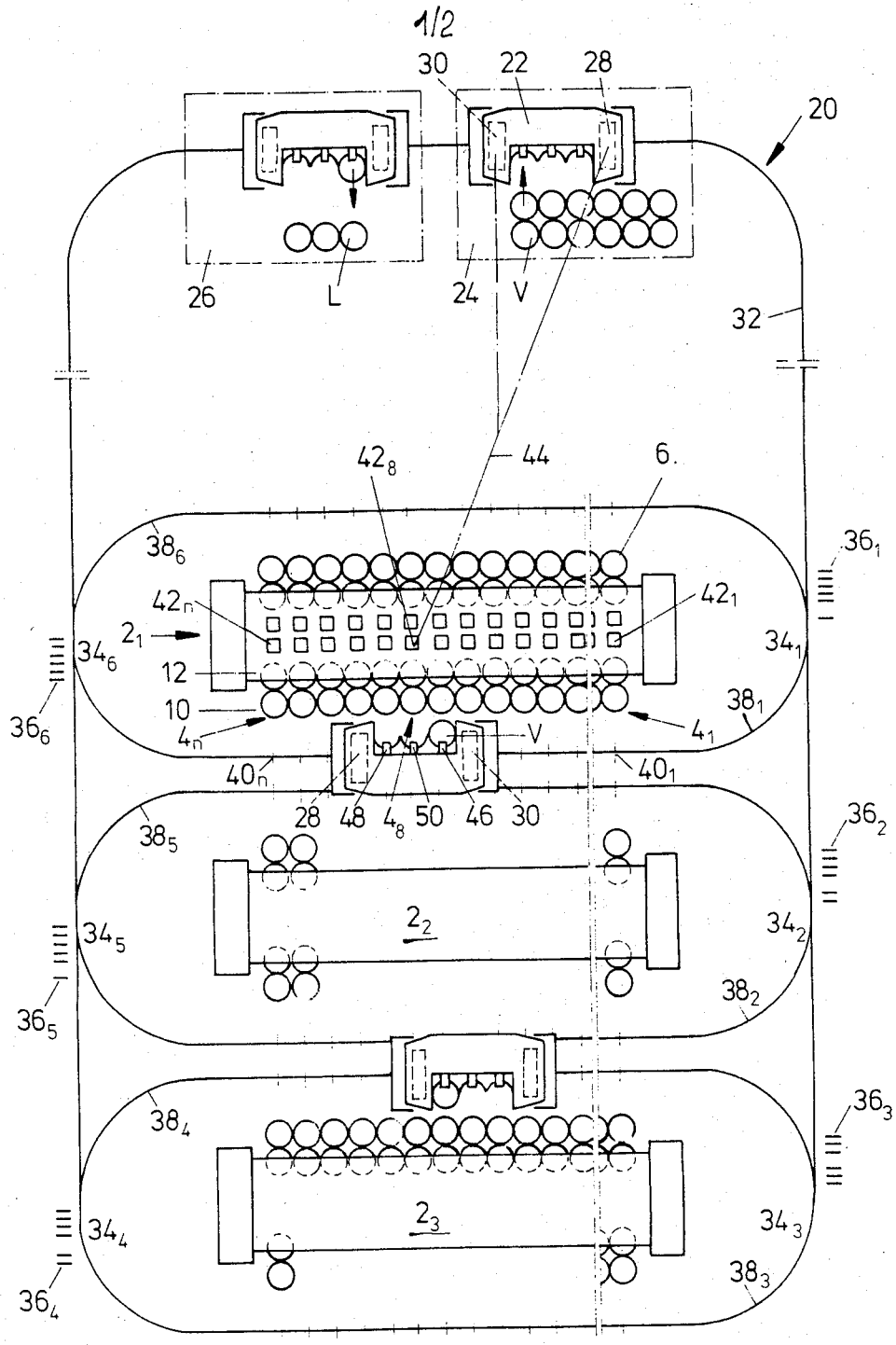
FIG. 1 is a diagram in plan view of an apparatus in accordance with the invention.
Figure 2:
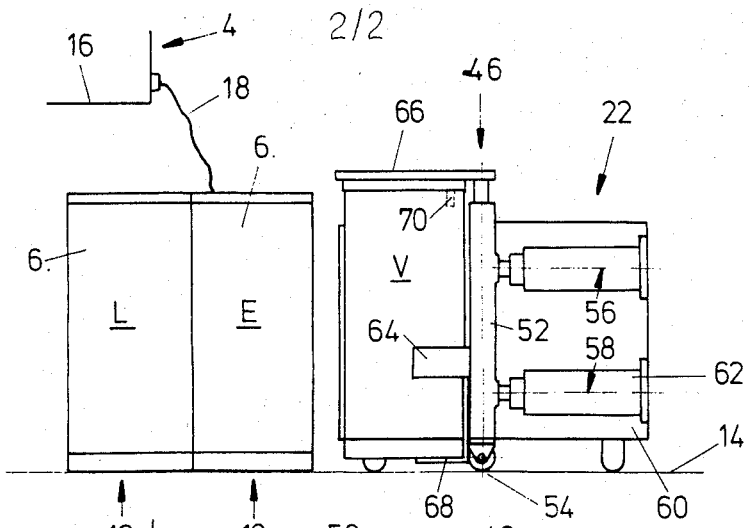
FIG. 2 is a front view of the floor conveyor truck with a first embodiment of an arm and with a full can in front of a spinning unit, taken transverse to the direction of movement of the track.

FIG. 1 is a diagram of the apparatus with several spinning machines $2_1$, $2_2$, $2_3$, arranged parallel to one another and at a distance from each other. Each of the spinning machines has on each side a number of spinning units $4_1$, up to $4_n$. At each spinning unit, two cans 6 are arranged one behind the other, so that on each side of the machine there are two rows of such cans, a frontal row 10 and a rear row 12. The cans stand on the bottom 14 underneath the spinning unit, whereby the cans 6 of the rear row 12 stand partially under the machine frame 16. As can be seen especially from FIGS. 2 to 4, a fiber strand 18 is pulled out from the cans 6 and directed towards the spinning unit 4.

A floor-conveyor installation 20 with automatically movable floor-conveyor trucks 22 connects a supply station 24 and a can-discharge station 26 with the spinning units 4 of the spinning machines $2_1$ to $2_3$. Each floor-conveyor truck comprises a first control device 28 for the automatic conveying operation and a second control device 30 with a program for the control of the receiving and the discharge of the cans. The floor-conveyor trucks 22 move along a routing track 32. At the branching points $34_1$ to $34_6$, coded markers $36_1$ to $36_6$ are located next to the routing track 32, to which the first control device 28 responds and corresponding to a given target code automatically approaches the target, e.g. the spinning unit. In the route segments $38_1$ to $38_6$, along the spinning machines $2_1$ to $2_3$, the individual spinning units are marked on the floor by markers $40_1$ to $40_n$. By simply counting the markers, the floor-conveyor truck 22 finds the programmed spinning units 4. At each spinning unit, an instruction transmitter $42_1$ to $42_n$ is provided, which serves for transmitting orders to the floor-conveyor trucks and is connected to the supply station 24 via a conductor- or radio-connection 44, in order to order a floor-conveyor truck from there. The installation is so laid out that at any moment each side of the spinning machine $2_1$ to $2_3$ can be reached by a floor-conveyor truck in forward motion, without turning. Floor-conveyor installations with automatically running floor-conveyor trucks, which can be used in an installation of the present kind are widely known, for instance from the U.S. Pat. Nos. 2,996,137, 3,147,817, 3,482,644, particularly from U.S. Pat. Nos. 3,628,624, 3,948,342, 4,015,680.

Each floor-conveyor truck has a first arm 46 for receiving a full can V at the supply station 24 to deliver it to a spinning unit. A second arm 48 serves for receiving an empty can L from the spinning unit. A third arm 50 serves for the time-limited gripping of a can E being used at the spinning unit in order to retrieve it and to transfer it from one row 10 in the other row 12. As can be seen particularly from FIGS. 2 to 4, each arm has a carrier column 52, whose lower end rests on the floor 14 via swivable casters 54. The carrier column 52 is connected with the chassis 60 of the floor-conveyor truck 22 by means of extendable thrust rods 56, 58. The thrust rods in the present example are formed by a telescopic piston/cylinder assembly 62, which preferably is hydraulically actuated. At the lower side of the carrier column 52 lateral brackets 64 are provided, which grip the can at its circumference, Further, the carrier column 52 is provided with a holder 66, which holds the can affixed to the arm. In a first embodiment according to FIG. 2, the carrier column 52 has a support extension 68 at its lower end, for the engagement of the cans. The holder 66 is an immobilizer which is movable in vertical direction and preferably engages the can from above. Close to the carrier column 52, the holder 66 has a holding extension 70, which engages the can and holds it at the carrier column 52.

Figure 3:
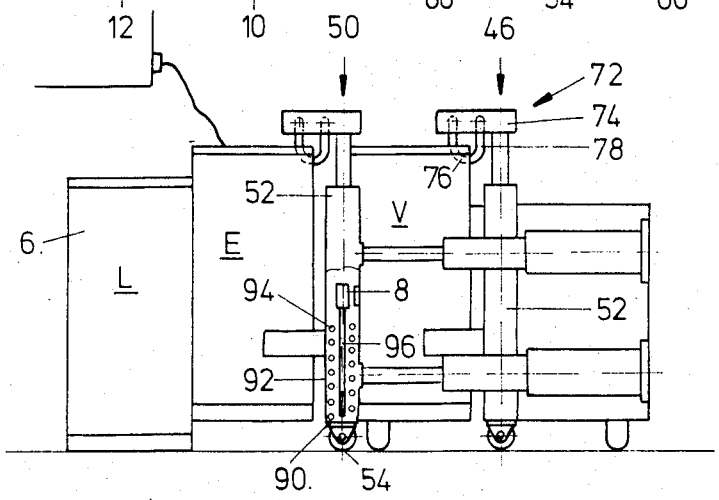
FIG. 3 is a similar view a floor conveyor truck with a second embodiment of the arm when receiving a can in service at the spinning unit.

In the embodiment of FIG. 3, the carrier column has no lower support extension and the holder 72 is a vertically movable bracket. The holder has a horizontal arm 74 engaging over the rim of the can and which at its lower side is provided with downwardly protruding clamping jaws 76, 78. These can be opened and closed via means not represented in the drawing. In order to apply the arm, the clamping jaws 76, 78 are opened and the arm 74 is vertically shifted until the clamping jaws 76, 78 can pass over the top rim of the can. The holder 72 is then lowered, until the clamping jaws 76, 78 can engage over the upper rim of the can. The means which are not shown serve then for the tightening of the clamping jaws 76, 78, which secure the can to the arm. By further movement of holder 72 in the vertical direction, the can is lifted off the floor, so that it has the necessary freedom of movement, as shown in FIG. 3. The tigthened clamping jaws 76, 78 suffice to secure the can, so that a lower support extension 68 can be eliminated. Lateral support arms 64 insure sufficient lateral grip.

Figure 4:
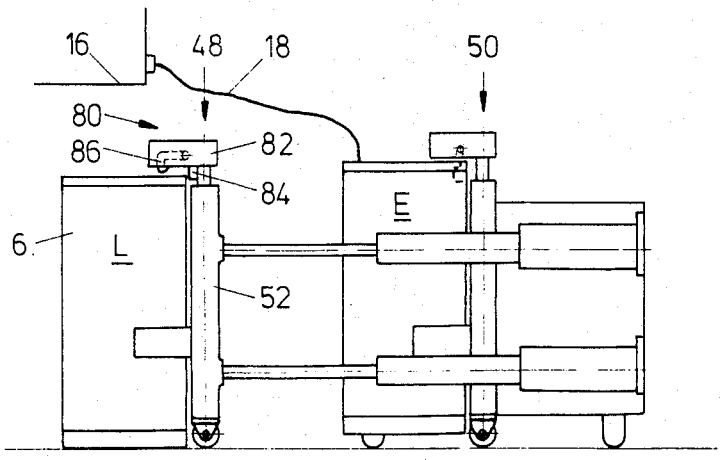
FIG. 4 is another front view of a floor conveyor truck with a third embodiment of an arm receiving an empty can.

FIG. 4 shows a further embodiment example of an arm, wherein the holder 80, similar to the holder 72, has clamping jaws 84, 86 on an arm 82. The clamping jaw 84, assigned to the carrier column is vertically oriented and rigidly mounted. On the contrary, the movable clamping jaw 86 is actuatable by means not shown in the drawing and in open position lies horizontally in the arm 82. As a result, the holder 80 with the arm 82 has to be lifted less high in order to be able to engage over the rim of a can, than the holder 72 in FIG. 3. This is particularly advantageous where the space between the can 6 and the machine frame is relatively limited.

As shown in FIG. 3, the arm 50 is equipped with a sensor 8 capable of assessing the weight of the can E to be received, the sensor being connected in a manner which is not closer illustrated with the second control device. For this purpose, the swivel bearing 90 of the caster 54 is supported on a spring 92, which in its turn is supported on an inner flange 94 in the carrier column 52. The swivel bearing 90 is in addition connected to a rod 96, actuating the sensor 8. With the aid of the sensor 8, it is possible to establish the difference between the full can V, the empty cans L and the cans in use still partially filled E.

The operation of the installation is performed as per the following example.

If at one of the spinning units $4_8$ the fiber supply in a can 6 is running short, over a corresponding transmitter $42_8$ via the connection 44 a signal is sent to the supply station 24. Thereby, the first and the second control devices 28, 30 of a floor-conveyor truck can also be simultaneously activated. The second control 30 actuates thereby the first arm 46, which receives from a stock a full can V. After the receiving operation is concluded, the first control 28 is activated and provided with the target codes given by the transmitter $42_8$. The floor-conveyor truck 22 is set into motion along the routing track 32. If the floor-conveyor truck when reaching the branching point $34_1$ establishes that the target code is within stretch $38_1$, the truck turns at the branching point $34_1$. By simply counting the markings $40_1$ to $40_8$, the floor-conveyor truck reaches the spinning unit $4_8$.

The floor-conveyor truck stops in front of the spinning unit $4_8$ in such a manner that the third arm 50 lies directly opposite the front can E in the first row, which is in use at the moment. The can-exchange program in the second control device initiates the can exchange. The third arm 50 grips now the can E which is in use and carries it to the floor-conveyor truck (FIG. 3). The floor-conveyor truck then retreats by one division, until the second arm 48 is opposite the spinning unit $4_8$. The second arm 48 grips the empty can L standing in the second row 12 (FIG. 4) and takes it to the floor-conveyor truck. After that, the floor-conveyor truck advances by one division, until the third arm 50 is again located opposite the spinning unit $4_8$. The arm 50 takes now the can E still in use to the second row 12 and deposits it there. After the arm 50 is retracted, the floor-conveyor truck advances again by one divison, until the first arm 46 comes to stand oppositely to the spinning unit $4_8$. The first arm 46 deposes now the full can V in the first row 10 in front of the spinning unit $4_8$. After the arm 46 is retracted, the can-exchange is concluded, and the control 28 transmits the order to move in the direction of the can-discharge station 26. There, the second arm 48 disposes of the empty cans at a shocking place. Thereafter, a new optional cycle can be initiated.

I claim:

1. An apparatus for the automatic transfer of cans in a spinning plant comprising a plurality of spinning machines each having a plurality of spinning units on opposite sides of the machine, and two cans disposed one behind another at each spinning unit, said apparatus comprising:

at least one truck provided with three parallel-movable arms disposed one beside another in a direction of displacement of said truck;

means defining a floor conveyor path for said truck having a supply station stocked with a plurality of full cans, a discharge station for receiving empty cans and a first control means responsive to can emptying at any of said units for directing said truck along said path from said supply station to the respective spinning machine and positioning the truck opposite said spinning unit requiring can replacement;

means on second control means on said truck for positioning a first of said arms at said one of said units for removing a front can at said one of said units, thereafter positioning a second arm of said truck opposite said one of said units for gripping a rear can and removing same, for positioning said first arm opposite said one of said units to replace the front can in the position of the rear can, and for positioning the third of said arms with a full can from said supply station in front of the can replaced at said one of said units by said first arm; and means to each of said arms for gripping and retaining a respective can for transfer from and to each unit and for transfer of cans to and from said station.

2. The apparatus as defined in claim 1 wherein each of said arms is formed with a vertical carrier column riding on a floor of said apparatus with a caster and advanced to said stations and units and retracted from said station and units with thrust rods, each of said columns having lateral support arms engageable around a respective can.

3. The apparatus as defined in claim 2 wherein said means on each of said arms for gripping said cans includes a support engageable beneath a can and a vertically movable member at the top of the respective column for clamping each can against said support.

4. The apparatus as defined in claim 2 wherein said means on each of said arms for gripping said cans includes an arm provided with a pair of jaws engageable with an upper rim of the respective can.

5. The apparatus as defined in claim 4 wherein one of said jaws is rigidly mounted and the other of said jaws is swingable in the direction of the rigidly mounted jaw horizontally to engage said rim of said can.

6. The apparatus as defined in claim 2 wherein said path is defined by a rail-less floor conveyor for guiding said truck.

7. A method of changing cans in a spinning plant having a plurality of parallel spinning machines each formed along opposite sides thereof with a plurality of spinning units which are each provided with a pair of cans including a front can and a rear can, said method comprising the steps of:

(a) supporting a filled can at a supply station on one arm of a truck having three parallel-displaceable arms arrayed in a row parallel to a direction of displacement of said truck;

(b) guiding said truck with said filled can received by a first of said arms to a selected one of said units requiring can replacement and positioning a second of said arms opposite said one of said units;

(c) engaging said front can of said one of said units in said second arm and retracting said second arm to said truck;

(d) positioning a third of said arms opposite said one of said units and engaging the rear can thereof and retracting said rear can of said truck;

(e) positioning said second arm opposite said one of said units and disposing the front can thereat in the position previously occupied by the rear can;

(f) positioning said first arm opposite said one of said units and depositing said filled can thereat in the position originally occupied by said front can thereof; and (g) displacing said truck to a discharge station with said rear can as carried by said third arm.

* * * * *